United States Patent [19]

Brunnee et al.

[11] 4,405,860

[45] Sep. 20, 1983

[54] AUTOMATICALLY CONTROLLABLE LOADING APPARATUS FOR MASS SPECTROMETERS OR THE LIKE

[75] Inventors: Curt Brunnée; Lothar Delgmann; Günter Marten, all of Bremen, Fed. Rep. of Germany

[73] Assignee: Finnigan Mat GmbH, Bremen, Fed. Rep. of Germany

[21] Appl. No.: 225,828

[22] Filed: Jan. 19, 1981

[30] Foreign Application Priority Data

Jan. 25, 1980 [DE] Fed. Rep. of Germany ..... 3002575

[51] Int. Cl.[3] ..... H01J 49/26

[52] U.S. Cl. ..... 250/288; 250/289

[58] Field of Search ..... 250/288, 289, 441

[56] References Cited

U.S. PATENT DOCUMENTS

| | | | |
|---|---|---|---|
| 3,073,951 | 1/1963 | Burdg | 250/288 |
| 3,117,223 | 1/1964 | Brunnée | 250/288 |
| 3,590,243 | 6/1971 | Perrin et al. | 250/288 |
| 4,076,982 | 2/1978 | Ritter et al. | 250/288 |

OTHER PUBLICATIONS

Gurevich et al., "Carousel Sample Holder With Magnetic Rotational Drive," Instr. & Exp. Tech., vol. 19, No. 3, pt. 2, Plenum Pub. Corp., May-Jun. 1976, pp. 902-903.

*Primary Examiner*—Alfred E. Smith
*Assistant Examiner*—Carolyn E. Fields
*Attorney, Agent, or Firm*—Flehr, Hohbach, Test, Albritton & Herbert

[57] ABSTRACT

Automatically controllable loading apparatus for a mass spectrometer or like equipment comprises a rotatable disc for holding a plurality of sample carriers for successive movement into a transfer position. A push rod transfers successive sample carriers from the transfer position to a loading position. Guide means guide the push rod during its transfer movement. The guide means include a shut-off valve adjacent the loading position. Sealing means define in a fixed position between the valve and the transfer position at least one vacuum chamber adapted to be exhausted for the purpose of equalizing the pressure at opposite sides of said valve.

6 Claims, 10 Drawing Figures

AUTOMATICALLY CONTROLLABLE LOADING APPARATUS FOR MASS SPECTROMETERS OR THE LIKE

This invention relates to automatically controllable loading apparatus for mass spectrometers or like equipment of the kind having a vacuum chamber to which repeated access is required from outside for the purpose of loading the chamber with samples, specimens or other material (referred to hereinafter as "samples") requiring analysis or other investigation.

One of the difficulties of introducing samples into the ionising chamber of a mass spectrometer or the vacuum chamber of other equipment of the kind defined is that the chamber is subject to high vacuum while the sample is applied to a sample carrier outside the ionising chamber under atmospheric pressure and must then be inserted with the carrier into the chamber. Frequently used for this purpose is a push-rod one end of which is adapted to hold the sample carrier.

In order to introduce the one end of such a push- rod into the ionising chamber of a mass spectrometer, it is already known for the chamber to be preceded by a vacuum lock and a stuffing box seal with vacuum stages increasing towards the ionising chamber (Zeitschrift für Instrumentenkunde, Volume 68, May 1960, pages 97 et seq).

An automatic sample changer for mass spectrometers has been previously proposed in German Offenlogungsschrift No. 25 48 891 (equivalent to U.S. Pat. 4,076,982) and comprises a magazine which receives a plurality of sample carriers and is reciprocally displaceable, in front of an opening for entry of the push-rod into the vacuum region, in a direction transverse to the direction of movement of the pushrod. In this construction the push-rod is itself part of a complex advancing and sealing mechanism. A lock carriage is driven by a motor towards a support plate which is associated with the mass spectrometer at the entry side of the ion source, and which is provided with an O-ring seal. Against this is sealingly applied a stuffing box of the lock carriage. A main valve of the vacuum chamber is then opened so that the push-rod mounted in the stuffing box can be advanced into the vacuum chamber.

The above-described arrangement for automatic loading of mass spectrometers required movement of two members, namely the push-rod and the lock carriage, for carrying out a loading operation. A further disadvantage is that the stuffing box for the passage of the push-rod is subjected to severe wear and plastic deformation. The reliability of the apparatus in continuous operation is thus reduced.

An object of the present invention is to provide automatically controllable loading apparatus for mass spectrometers or like equipment of the kind defined in which sealing of the vacuum chamber during access is improved even during continuous operation.

In order to achieve this object the apparatus of the invention is characterised in that the push-rod is mounted in a stationary guide frame and can be advanced by stepwise feed to the magazine and then with the substance or the sample carrier can be moved through the stuffing box seal up to a high vacuum valve which, after evacuation of the stuffing box seal to the vacuum of the vacuum chamber, is opened for advance thereinto of the push-rod.

In the apparatus according to the invention the push-rod is mounted in a simple, stationary guide frame, for example on only two guide rods arranged in mutually spaced relationship. The axial movement of the push-rod in both directions takes places by means of a motor via a worm drive. In an entry channel arranged in advance of the vacuum chamber with the ion source is formed an evacuatable stuffing box with preferably three vacuum chambers which can be evacuated in stages down to the vacuum of the vacuum chamber.

The multiple, in particular three-stage stuffing box, coupled with appropriate dimensioning of the sealing bore and the push-rod diameter, permits a problem-free introduction of the pushrod through the stuffing box in such a way that in this region there is practically no friction. A corresponding low force is required for the transport of the push-rod.

The magazine for receiving the substances or the sample carriers is also constructed in a particular manner. The sample carriers are arranged in facing relationship with the push-rod along the periphery of a stationary, rotatably mounted disc. The sample carriers are brought into the receiving position by rotation of the magazine. A recess in the discshaped magazine permits passage of the push-rod when these are appropriately positioned relative to each other.

The invention will now be further described by way of example only, with reference to the accompanying drawings, in which.

Figure 1:
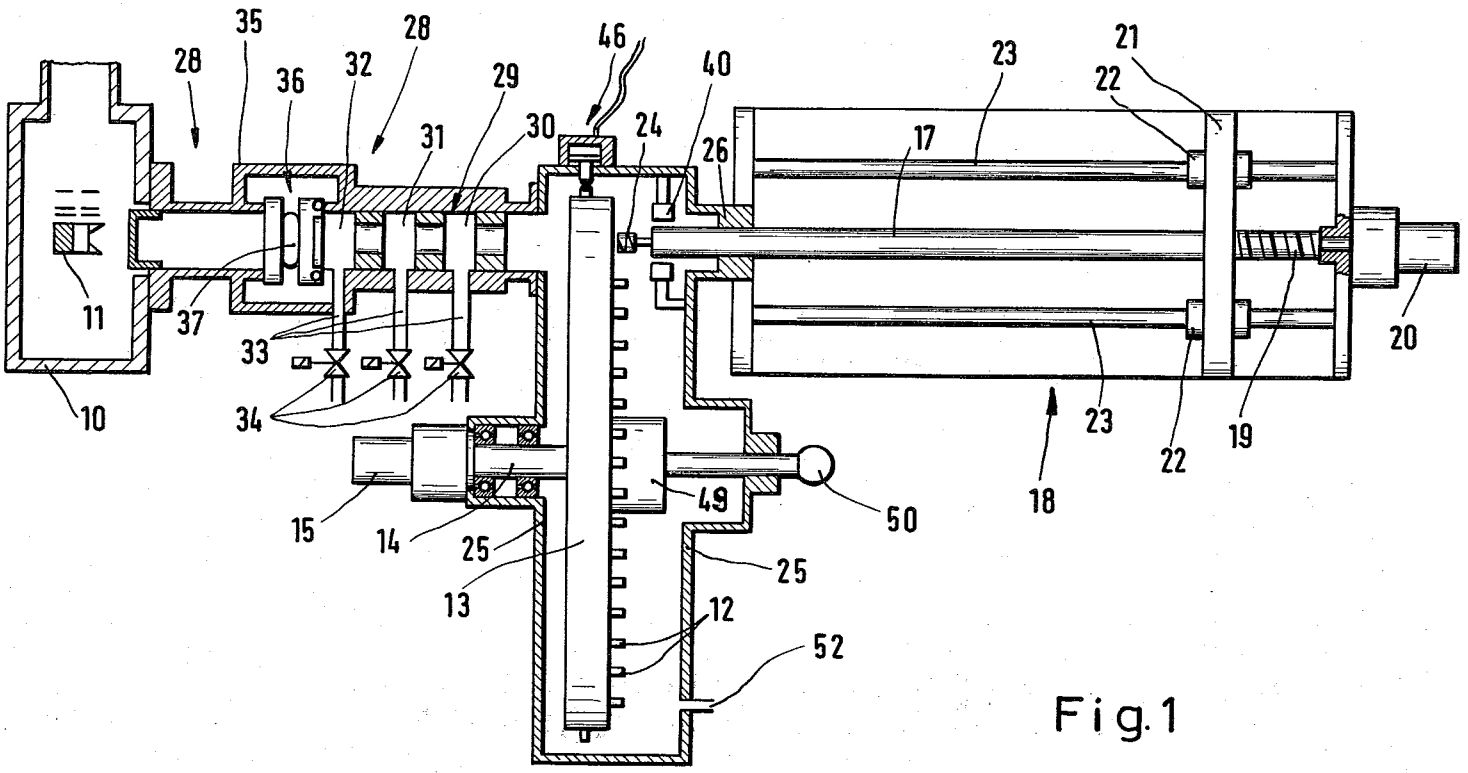
FIG. 1 is a diagrammatic view partly in plan and partly in horizontal section of one embodiment of apparatus according to the invention in a first operating position of a push-rod for introducing a sample into the high vacuum region of a mass spectrometer.

Referring now to the drawings, the apparatus of the invention is shown in association with an ionising chamber 10 of a mass spectrometer which is not otherwise illustrated. In the chamber 10 is an ion source 11 which is likewise shown diagrammatically. The loading apparatus of the invention is also suitable for association with other equipment having a vacuum chamber to which repeated access is required from outside for the purpose of loading the chamber with samples, specimens or other material requiring analysis or other investigation.

The apparatus forms a constructional unit which is attached to the mass spectrometer at the entry side of the ionising chamber 10.

The liquid or solid substances to be analysed are each contained in a sample carrier 12. This can be constructed in different ways, e.g. as a tubular element open at one side or as a capsule with an axial bore arranged at one side. The substance concerned is received therein.

Alternatively, the substance can be received on a wire loop or other sample carrier.

A plurality of sample carriers 12 each containing a sample is received in a sample magazine 13. In the illustrated embodiment the magazine 13 is constructed as a disc or wheel which is mounted on a central drive shaft 14 for stepwise rotation by a magazine motor 15 according to a predetermined variable programme.

A large number of sample carriers 12 is removably located adjacent the outer circumference of the sample magazine 13. In the present case the sample carriers 12 are so arranged that they extend in axis-parallel relationship and project from the sample magazine 13 on the side remote from the ionising chamber 10. FIGS. *7a* to *7d* show details of a holder 16 for the sample carries 12.

In accordance with an automatic programme the sample carriers 12 are removed from the sample magazine 13 by a push-rod 17 and introduced into the ionising chamber 10. Ionisation takes place in the chamber 10 in known suitable manner, e.g. by vaporisation of the sample.

For carrying out the transfer and transport movements the push-rod 17 is mounted in a guide frame 18 forming part of the apparatus of the invention. The push-rod 17 carries out exclusively axial movements in both directions. For this purpose it is driven by a circulating ball spindle 19 (ball nut and spindle) which is driven by a motor 20 controllable by a programme. In order to carry out precise linear movements the push-rod 17 is connected to a transverse strap 21 which is displaceably mounted by means of lateral bearings 22 (circulating ball bushes) on guide rods 23 arranged parallel to the push-rod 17.

The front end of the push-rod 17 remote from the motor 20 is provided with a coupling 24 for periodic reception of a sample carrier 12. In the retracted position this end region of the push-rod 17 lies within a magazine housing 25 which completely surrounds the sample magazine 13. At the entry region of the push-rod 17 the magazine housing 25 forms a bearing 26 for the push-rod 17.

The magazine housing 25 and the sample magazine 13 are offset in axis-parallel relationship to the path of movement of the push-rod 17 in such a way that there is always one sample carrier 12 at the edge of the sample magazine 13 which is held ready for transfer on the longitudinal axis of the push-rod 17 (FIG. 1).

Figure 6:
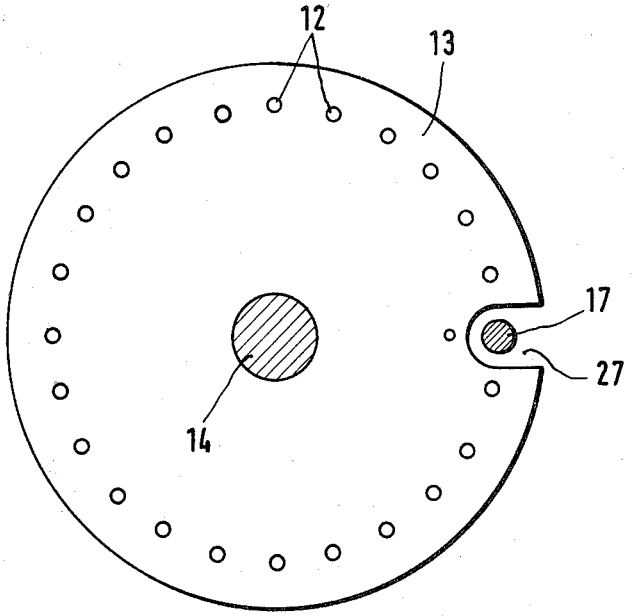
FIG. 6 is an end view of the sample magazine constituting part of the apparatus, and FIGS. *7a* to *7d* are detail views illustrating the mode of operation.

After a sample carrier 12 has been received by the push-rod 17 the sample magazine 13 is moved out of the path of movement of the push-rod 17. In the present case the sample magazine 13 is provided with an outwardly open peripheral recess 27 (FIG. 6) which is moved into the region of the push-rod 17 in order that the latter can be moved axially past the sample magazine 13.

Figure 3:
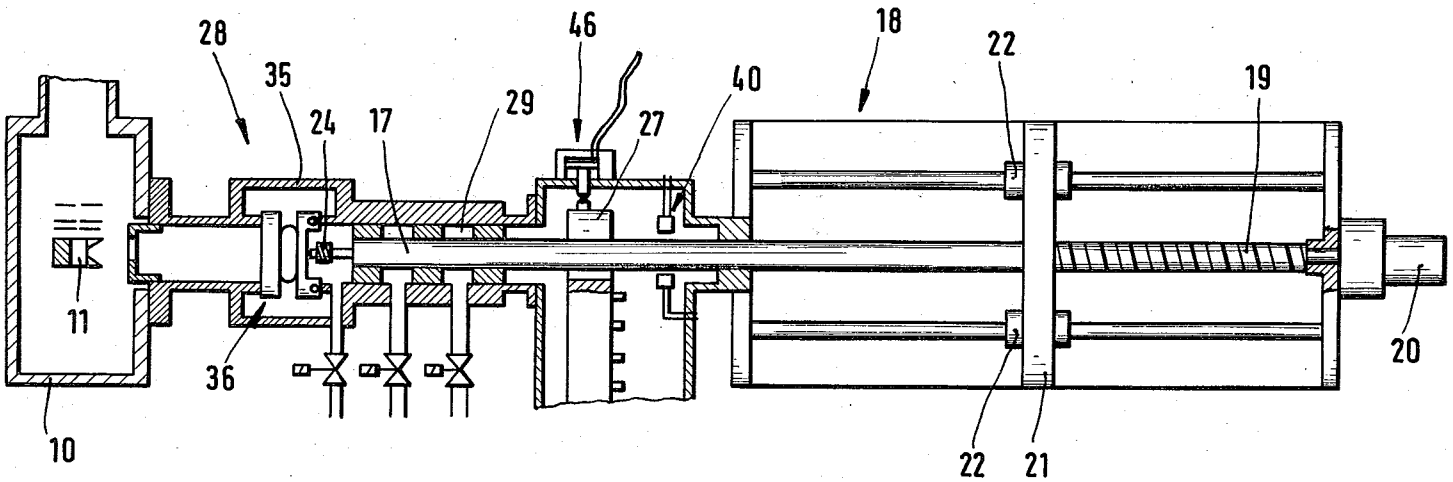
FIG. 3 is a corresponding view in the operating position immediately before introduction of the push- rod into the high vacuum region of the mass spectrometer.
Figure 4:
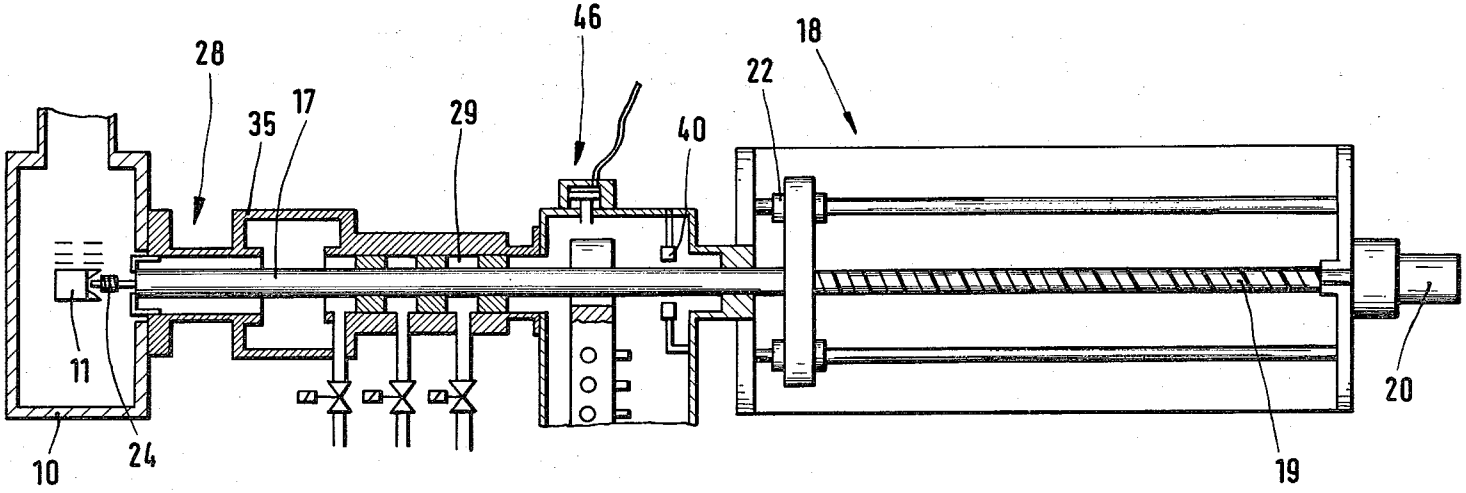
FIG. 4 is a corresponding view in the position when the push-rod enters the high vacuum region.

Connected to the magazine housing 25 is an entry channel 28 through which part of the push-rod 17 is guided. Within this entry channel 28 special sealingfeatures are provided. The present embodiment has a three-stage stuffing box 29 which sealingly surrounds the push-rod 17 (FIGS. 3 and 4). The stuffing box 29 has three vacuum chambers 30, 31, 32 which are subjected to different vacuums so that the vacuum is increased in steps from a region of atmospheric pressure at the magazine housing up to a high vacuum region in the ionising chamber. For this purpose the vacuum chambers 30, 31, 32 are connected to vacuum pumps (not shown) by suction pipes 33 with respective programmable solenoid valves 34.

Within the entry channel 28 adjoining the stuffing box 29 is a valve chamber 35 with a high vacuum valve36. This seals the region which is permanently subjected to high vacuum, namely the ionising chamber 10 and an adjacent section of the entry channel 28, from the higher pressure region. After extension of the push-rod 17 to the position shown in FIG. 3 the vacuum chambers 30, 31, 32 are evacuated and the high vacuum valve 36 is opened so that the push-rod 17 can be advanced into the ionising chamber 10.

Figure 5:
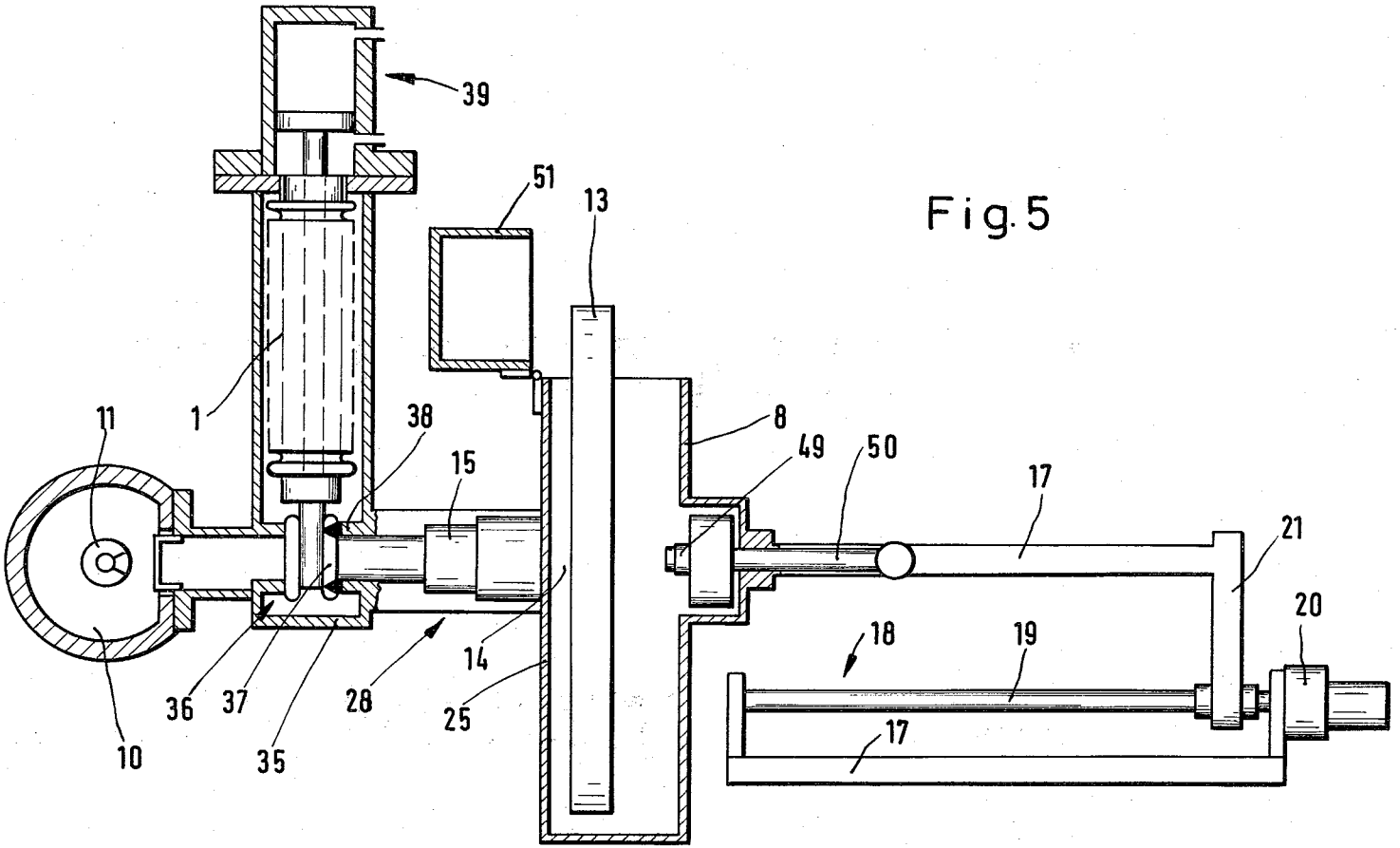
FIG. 5 is a diagrammatic view partly in elevation and partly in vertical section of the apparatus shown in the preceding Figures.

In the present embodiment (see particularly FIG. 5) the high vacuum valve 36 is built onto the side of the valve chamber 36. A valve element 37 seats in the closed position of the valve (e.g. FIG. 5) against an opposing flange 38 of the inlet channel 28. The high vacuum valve 36, i.e. is valve element 37, is pneumatically actuated by a pneumatic unit 39. In order to clear the entry channel 28 the valve element 37 is retracted from the path of the push-rod 17 (FIG. 4).

Figure 2:
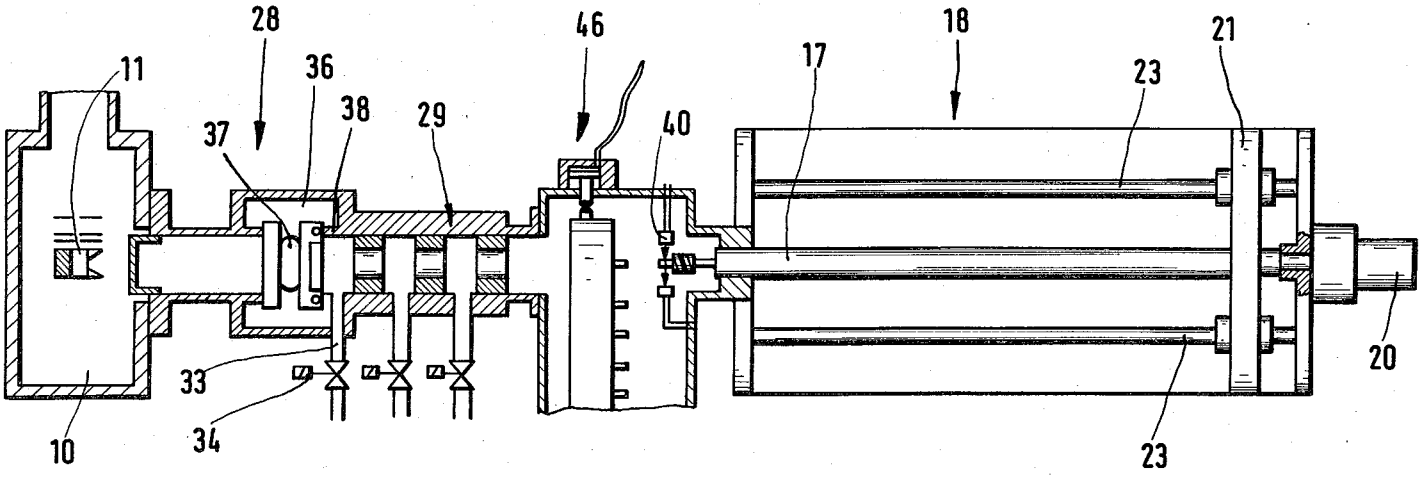
FIG. 2 is a corresponding view after the push-rod has received a sample carrier from a magazine.

If programmed to run automatically, as is preferred, the operation of the apparatus so far described is as follows:

From its retracted starting position (FIG. 2) the push-rod 17 is advanced to the sample magazine 13. As a result of this movement a sample carrier 12 is received at the front end of the push-rod 17 in the coupling 24. The push-rod 17 is then retracted into the starting position shown in FIG. 2. Here the presence of a sample carrier 12 on the push-rod 17 is sensed by means of an optical sensing device 40.

In the meantime the sample magazine 13 is rotated so as to bring the recess 27 into the path of movement of the push-rod 17. This is now advanced past the sample magazine 13 into the position shown in FIG. 3. At this stage the stuffing box 29 is at atmospheric pressure. The high vacuum valve 36 is still closed. The push-rod 17 is stopped in front of the high vacuumvalve 36 but lying completely within the stuffing box 29. The valve chambers 35 are now evacuated to create a vacuum which progressively increases from the atmospheric pressure region to the high vacuum valve 36. In the vacuum chamber 32 is produced the same high vacuum that obtains in the ionisation chamber 10.

The high vacuum valve 36 is now opened i.e. moved out of the path of the push-rod 17. This can now be advanced into the ionising chamber 10. Here the substance to be investigated can be handled and ionised in conventional fashion.

The push-rod 17 is then retracted into the starting position in a similar manner by reversing the sequence of operations, whereby in an intermediate position the "used" sample carrier 12 is reinserted into the sample magazine 13. Then the sensing device 40 is used to confirm the absence of a sample carrier 12 and the push-rod 17 is fed to a further sample carrier 12.

The holder 16 for the sample carriers 12 on the sample magazine 13 can be constructed in different ways. The illustrated embodiment proposes a mechanical arrangement with pneumatic actuation.

The elongated sample carriers 12 are clamped in a shoulder 41 at the edge of the sample magazine 13. The axially disposed sample carriers 12 are mounted with one end fixed in a bore 42 of the sample magazine 13 by a transversely movable clamping element 43 engaging in the bore 42. The clamping element 43 is connected to a radially directed movable actuating pin 44 one end of which projects from the edge of the sample magazine 13. The actuating pin 44 is movable radially inwardly of the sample magazine 13 against the load of a compression spring 45 so as to withdraw the clamping element 43 from its clamping position.

Figure 7A:
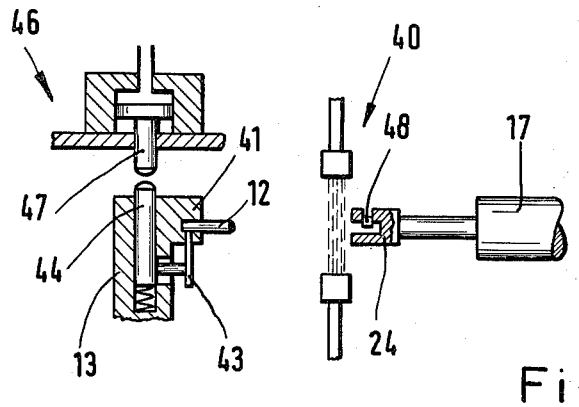
Figure 7B:
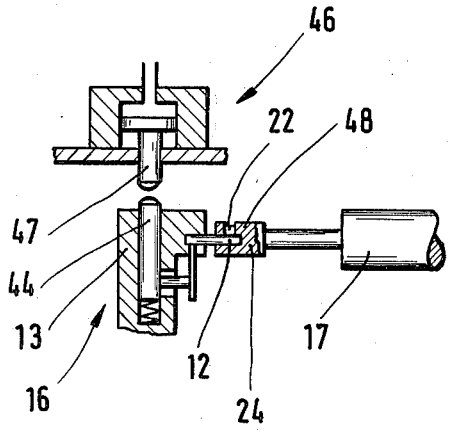
Figure 7C:
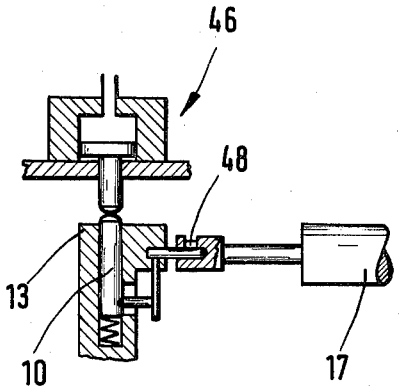
Figure 7D:
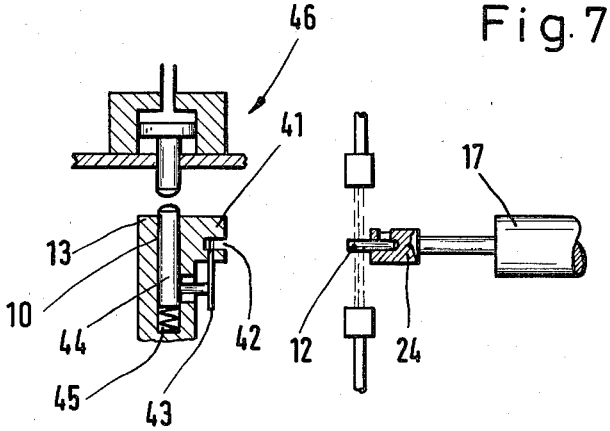

The actuating pin 44 is associated with a release device 46 fixed on the magazine housing 25. This comprises a pneumatically actuated pressure pin 47 which is extended to displace the actuating pin 44 in the radial direction. The sample carrier 12 is thus released from the clamping position (FIG. 7*c*).

In the above position the sample carrier 12 is received in the coupling 24 by a section remote from the substance. By retracting the push-rod 17 when the holder 16 is released the sample carrier 12 can be removed from the bore 42.

The coupling 24 is likewise provided with an axial bore in which the sample carrier 12 is held by the clamping action of a spring 48. The bore containing the substance to be analysed is in this case disposed outside the region of the coupling 24.

The return of the "used" sample carrier 12 to the sample magazine 13 is accomplished in the reverse sequence. The sample carrier 12 is introduced into the bore 42 in the position according to FIG. 7*c*. By withdrawing the pressure pin 47 the clamping element 43 is enabled to clamp the sample carrier 12 in the bore 42. The holding force is greater than that of the spring 48 so that on withdrawing the push-rod 17 the sample carrier 12 is retained in the sample magazine 13.

The coupling 24 of the push-rod 17 can be so constructed that controlled heating thereof and thus vaporisation of the substance can be achieved.

The sample magazine 13 is provided on its side opposite the drive shaft 14 with an axially displaceable counterbearing 49 which can be axially displaced, i.e. retracted, by means of a handle 50 projecting from the magazine housing 25. In this way it is possible to remove the sample magazine 13 from the drive shaft 14 and withdraw it from the magazine housing 25 for filling or other operation. For this purpose the magazine housing 25 is provided with a hinged cover 51 formed by the upper region thereof. A protective gas can be introduced into the magazine housing 25 by means of a gas connection 52.

We claim:

1. Automatically controllable loading apparatus for loading a sample holder carried by a bush rod into a high vacuum chamber of a mass spectrometer, said high vacuum chamber having an entrance channel closed by a valve and having a plurality of aligned stuffing boxes and vacuum chambers arranged in the axis of movement of said push rod comprising: a stationary frame for slidably retaining said push rod with an axis of movement coincident with said stuffing boxes; a disc mounted for rotation on said stationary frame on an axis displaced from but parallel to said axis of movement of said push rod and carrying adjacent its periphery a plurality of removable sample holdes, such holders having a circular locus of movement intersecting said axis of movement of said push rod; said disc also having in place of one of said sample holders a peripheral recess for permitting passage of said push rod toward said high vacuum chamber; means for rotating said disc to place said peripheral recess in the axis of movement of said push rod; and means for advancing said push rod through said recess and into said entrance channel.

2. Apparatus as claimed in claim 1 wherein the sample holders extend axially of said disc and are each received in a respective individually actuatable holder by clamping.

3. Apparatus as claimed in claim 2 wherein the sample holders are associated with a release mechanism in a transfer position.

4. A method of automatically loading a sample holder carried by a push rod into a high vacuum chamber of a mass spectrometer where the high vacuum chamber has an entrance channel closed by a valve and having a plurality of aligned stuffing boxes and vacuum chambers successively arranged in the direction of movement of the push rod, where the sample holders are inserted and stored on one side of a rotatably mounted disc adjacent its periphery, the disc also having a peripheral recess instead of one of such sample holders comprising the following steps:

(A) retracting said push rod;
(B) rotating said disc so that a predetermined sample holder is opposite said push rod;
(C) advancing the push rod to pick up said sample holder;
(D) retracting said push rod with said predetermined sample holder;
(E) rotating said disc to place said peripheral recess of said disc opposite said push rod;
(F) advancing said push rod to move through said recess and through said plurality of vacuum chambers and stuffing boxes;
(G) placing graduated higher vacuums on said chambers closer to said entrance valve;
(H) opening said valve;
(I) advancing by means of said push rod said sample holder into said high vacuum chamber of said mass spectrometer;
(J) vaporizing at least a portion of the sample in the sample holder; and
(K) retracting said push rod and sample holder.

5. The method as in claim 4 including after step (K) rotating said disc to its original position and advancing said push rod to replace or reinsert said sample holder in its said original position.

6. A method as in claim 4 including the step of individually actuating a release mechanism to allow said sample holder to be removed by said push rod and to again actuate the release mechanism to allow said sample holders to be reinserted.

* * * * *